US007619354B2

(12) United States Patent
Kamiguchi et al.

(10) Patent No.: US 7,619,354 B2
(45) Date of Patent: Nov. 17, 2009

(54) ANODE CAP, AND VOLTAGE SUPPLY UNIT AND IMAGE DISPLAY APPARATUS UTILIZING THE SAME

(75) Inventors: Kinya Kamiguchi, Tokyo (JP); Kazuhiro Ota, Hiratsuka (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 429 days.

(21) Appl. No.: 11/376,239

(22) Filed: Mar. 16, 2006

(65) Prior Publication Data

US 2006/0228951 A1 Oct. 12, 2006

(30) Foreign Application Priority Data

Apr. 7, 2005 (JP) ..... 2005-110707

(51) Int. Cl.
*H01R 13/52* (2006.01)
*H01J 29/20* (2006.01)
*H01R 13/502* (2006.01)
*H01R 13/35* (2006.01)

(52) U.S. Cl. ..... 313/495; 313/422; 439/588; 439/702; 439/753

(58) Field of Classification Search ..... None
See application file for complete search history.

(56) References Cited

U.S. PATENT DOCUMENTS

| | | | | |
|---|---|---|---|---|
| 4,894,023 | A * | 1/1990 | Hall | 439/278 |
| 2003/0122472 | A1* | 7/2003 | Kawase | 313/422 |
| 2004/0061697 | A1* | 4/2004 | Yoshino | 345/211 |
| 2004/0127094 | A1* | 7/2004 | Kamiguchi | 439/521 |
| 2004/0233137 | A1* | 11/2004 | Kodera et al. | 345/75.2 |

FOREIGN PATENT DOCUMENTS

| | | |
|---|---|---|
| JP | 7-029626 | 1/1995 |

* cited by examiner

*Primary Examiner*—Sikha Roy
*Assistant Examiner*—Tracie Green
(74) *Attorney, Agent, or Firm*—Fitzpatrick, Cella, Harper & Scinto

(57) ABSTRACT

An image display apparatus includes a display panel with an aperture, an anode terminal for applying a voltage to the display panel through the aperture, and an anode cap, attached on an external surface of the display panel, for holding an electroconductive wire applying a voltage to the anode terminal. In addition, a fixing member has a through hole in which the anode terminal is inserted for fixing the anode cap at an inside portion of the anode cap. The anode cap includes a fastening portion detachably fastened to the fixing member within the anode cap.

7 Claims, 6 Drawing Sheets

ANODE CAP, AND VOLTAGE SUPPLY UNIT AND IMAGE DISPLAY APPARATUS UTILIZING THE SAME

BACKGROUND OF THE INVENTION

1. Field of the Invention

The present invention relates to an anode cap for connecting an electroconductive wire to an anode terminal of a display panel, a voltage supply unit utilizing such anode cap, and an image display apparatus equipped with such unit.

2. Related Background Art

In a cathode ray tube of a television receiver, an anode voltage supply is achieved by electrically connecting an electroconductive wire, connected to a high voltage source with a so-called anode button provided on an external surface of the cathode ray tube, and such electrical connection is achieved by inserting and fixing an anode button-fastening piece, provided at a free end of the electroconductive wire, into the anode button (cf. Japanese Patent Application Laid- open No. H07-029626).

Since the anode button is embedded in an external wall constituting the cathode ray tube as shown in Japanese Patent Application Laid-open No. H07-029626, FIG. 10, a stress concentration occurs in a portion of the external wall in which the anode button is embedded, in attaching or detaching the anode button-fastening piece. In a flat display panel constructed with a thin glass substrate, an anode button of such embedded type may result in destruction of the substrate by a stress involved in an attaching/detaching operation.

SUMMARY OF THE INVENTION

An object of the present invention is to achieve, in a display panel such as a flat panel type or a cathode ray tube, a satisfactory electrical connection between an anode terminal and an electroconductive wire for supplying a voltage thereto, and also to enable attaching/detaching of the electroconductive wire and to relax stress exerted to the display panel at the attaching/detaching operation, thereby preventing damage to the display panel at the attaching/detaching operation.

The present invention is to provide an anode cap detachably attached to a display panel having an anode terminal on an external surface thereof, the anode cap including a holding unit for holding an end of an electroconductive wire for supplying a voltage to the anode terminal, and a fastening portion for detachably fastened to a fixing member fixed around the anode terminal.

Also the present invention provides a voltage supply unit to be detachably attached to a display panel having an anode terminal on an external surface thereof, the voltage supply unit including an electroconductive wire for supplying a voltage to the anode terminal, and an anode cap including a holding unit for holding an end of the electroconductive wire and a fastening portion for detachably fastening with a fixing member fixed around the anode terminal.

Also the present invention provides an image display apparatus provided with a display panel having an anode terminal on an external surface thereof, and a voltage supply unit for supplying a voltage to the anode terminal, wherein the voltage supply unit is a voltage supply unit described above and the display panel has a fixing member fixed around the anode terminal and fastened to the fastening portion of the anode cap of the voltage supply unit, whereby an end of the electroconductive wire supported by the holding unit of the anode cap is electrically connected with the anode terminal.

DETAILED DESCRIPTION OF THE PREFERRED EMBODIMENTS

The present invention provides, in a first aspect thereof, an anode cap detachably attached to a display panel having an anode terminal on an external surface thereof, the anode cap including a holding unit for holding an end of an electroconductive wire for a voltage supply to the anode terminal, and a fastening portion for detachably fastened to a fixing member provided around the anode terminal.

Also the present invention provides, in a second aspect thereof, a voltage supply unit to be detachably attached to a display panel having an anode terminal on an external surface thereof. The voltage supply unit includes an anode cap of the present invention and an electroconductive wire of which an end is supported by a holding unit of the anode cap.

Also the present invention provides, in a third aspect thereof, an image display apparatus provided with a display panel having an anode terminal on an external surface thereof, and a voltage supply unit for a voltage supply to the anode terminal, wherein the voltage supply unit is a voltage supply unit of the present invention. The display panel has a fixing member which is fixed around the anode terminal and fastened to the fastening portion of the anode cap of the voltage supply unit, whereby an end of the electroconductive wire supported by the holding unit of the anode cap is electrically connected with the anode terminal.

According to the present invention, most of the stress, in attaching or detaching the voltage supply unit to or from the display panel, is applied to the anode cap constituted of an elastic member, and the display panel can be protected from being damaged in attaching/detaching of the voltage supply unit.

Figure 1:
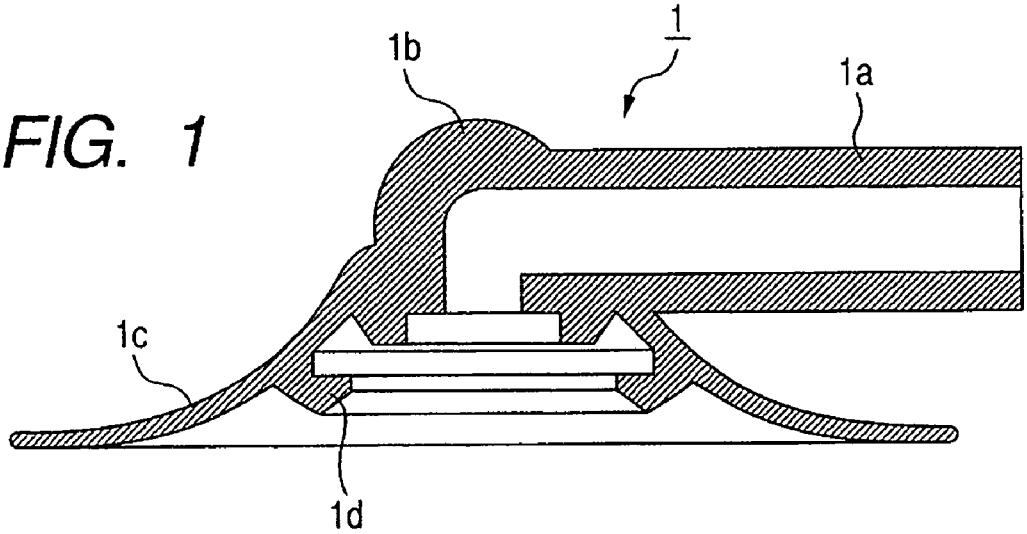
FIG. 1 is a schematic cross-sectional view of an anode cap in a preferred embodiment of the present invention.
Figure 2:
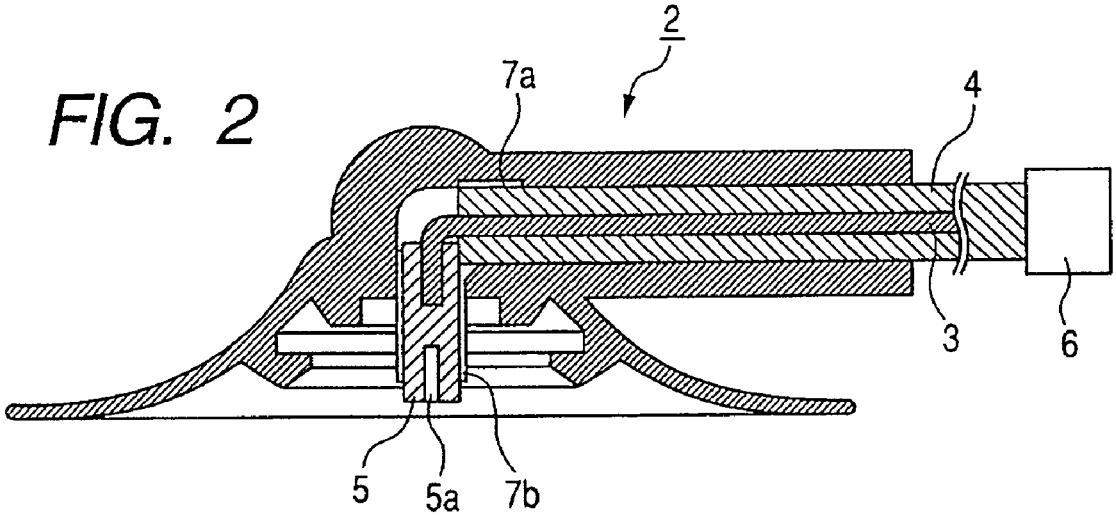
FIG. 2 is a schematic cross-sectional view of a voltage supply unit in a preferred embodiment of the present invention.
Figure 3:
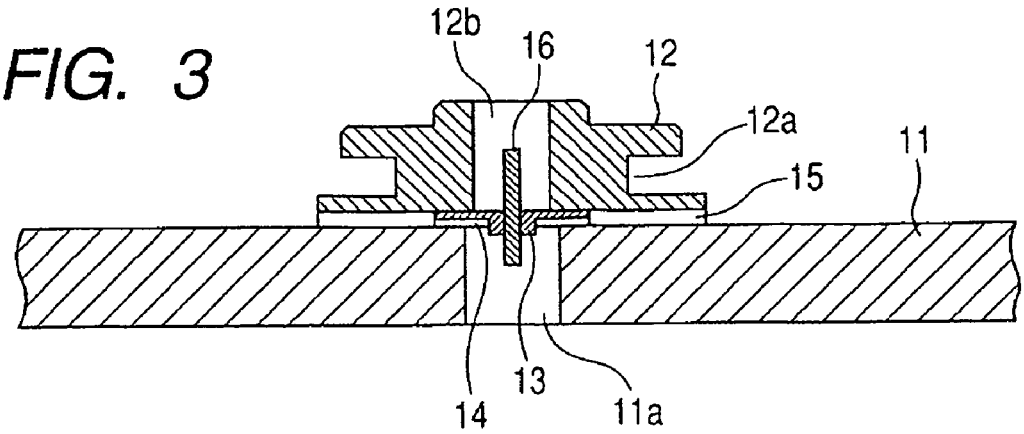
FIG. 3 is a schematic cross-sectional view showing a periphery of an anode terminal of a display panel.
Figure 4:
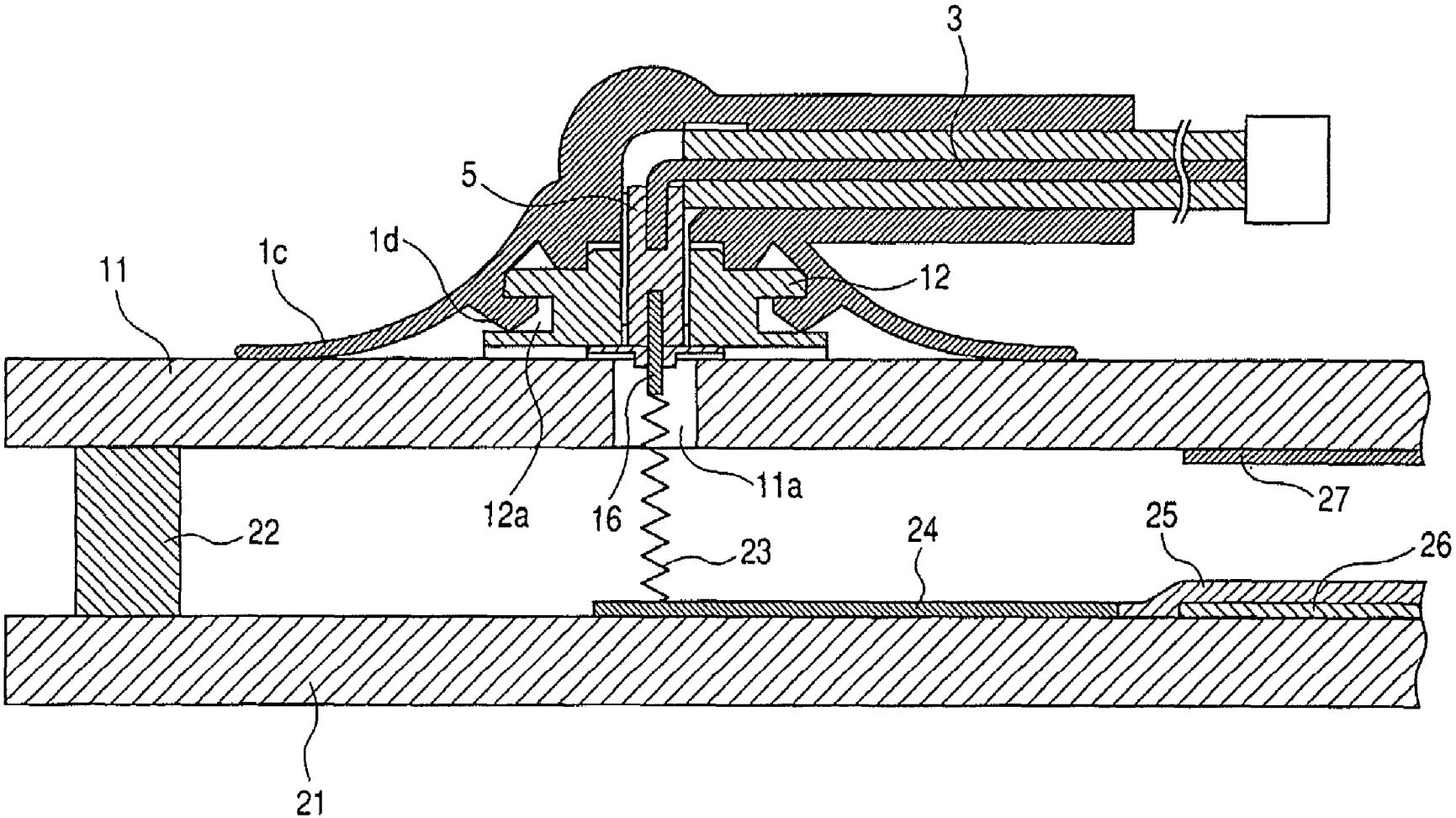
FIG. 4 is a schematic cross-sectional view of an image display apparatus in an embodiment of the present invention.

FIG. 1 is a schematic cross-sectional view of an anode cap in a preferred embodiment of the present invention; FIG. 2 is a schematic cross-sectional view of a voltage supply unit, in a preferred embodiment of the present invention, utilizing such anode cap; FIG. 3 is a schematic cross-sectional view showing a periphery of an anode terminal of a display panel on which the voltage supply unit shown in FIG. 2 is to be mounted; and FIG. 4 is a schematic cross-sectional view of a display panel in an embodiment of an image display apparatus in an embodiment of the present invention, equipped with a fixing member shown in FIG. 3 and a voltage supply unit shown in FIG. 2.

In FIGS. 1, 2, 3 and 4, there are shown an anode cap 1, a hollow cylindrical portion l*a*, a top portion 1*b*, a cover portion 1*c*, a convex portion 1*d*, a voltage supply unit 2, an electroconductive wire 3, a cable 4, a fitting portion 5*a*, a voltage source 6, a detachment preventing member having a cable holding unit 7*a* and a connecting member holding unit 7*b*, a display panel substrate 11, a fixing member 12, a concave portion 12*a*, a through hole 12*b*, a sealing member 13, adhesive materials 14, 15, an anode terminal 16, a substrate 21, an outer frame 22, an elastic member 23, a lead wire 24, a metal back 25, a phosphor film 26 and an electron source 27.

The anode cap 1 of the present invention is constituted of an insulating member, and is provided with a holding unit for holding an end of an electroconductive wire 3 for voltage supply to the anode terminal 16, and a fastening portion for fastening with a fixing portion 12 which is fixed around the anode terminal 16. An embodiment shown in FIGS. 1 and 2 includes a hollow cylindrical portion l*a* as the holding unit, and a space constituting a fastening portion for fitting the fixing member 12 therein, as will be explained later.

The anode cap 1 shown in FIG. 1 is provided therein a convex portion 1*d* in a position corresponding to a concave portion 12*a* formed on the external periphery of the fixing member 12. When the anode cap 1 is positioned over the fixing member 12, the convex portion 1*d* is fitted in the concave portion 12*a* thereby fixing the anode cap 1 on the fixing member 12. In the present invention, type of fastening of the anode cap 1 and the fixing member 12 is not particularly restricted. There may be employed any type of fastening that is not disengaged by a certain impact after mounting and that allows an easy disengagement. The anode cap may be made easily attachable and detachable by forming mutually corresponding convex portion and concave portion in the interior of the anode cap 1 and on the external periphery f the fixing member 12. The convex portion and the concave portion are not particularly restricted in the shape thereof, but the convex portion or the concave portion is preferably made elastic in order to facilitate attaching and detaching. At least a part including such convex portion or concave portion is preferably formed by an elastic member, specifically with silicone rubber. There can also be preferably employed a form in which either of the fixing member 12 and the anode cap 1 is screw fitted to the other.

Further, the anode cap of the present invention preferably has an appropriate elasticity also in the hollow cylindrical portion 1*a*, the top portion 1*b* and the cover portion 1*c*, and is preferably formed integrally, including the convex portion 1*d*, by an elastic material. More specifically, it is preferably formed by injection molding with silicone rubber.

The voltage supply unit of the present invention includes an anode cap 1 and an electroconductive wire 3 of which an end is supported by a holding unit of the anode cap 1. In the embodiment shown in FIG. 2, a connection member 5 constituted of an electroconductive material is employed for fixing an end of the electroconductive wire 3 in the anode cap 1 thereby achieving a satisfactory connection with the anode terminal 16. The connection member 5 is provided, at an end thereof, with a fitting portion in which an end of the electroconductive wire 3 is inserted and fixed by soldering (not shown), and is also provided, at the other end thereof, with a fitting portion 5*a* for inserting the anode terminal 16. The connection member 5 is preferably formed for example with brass.

Figure 5:
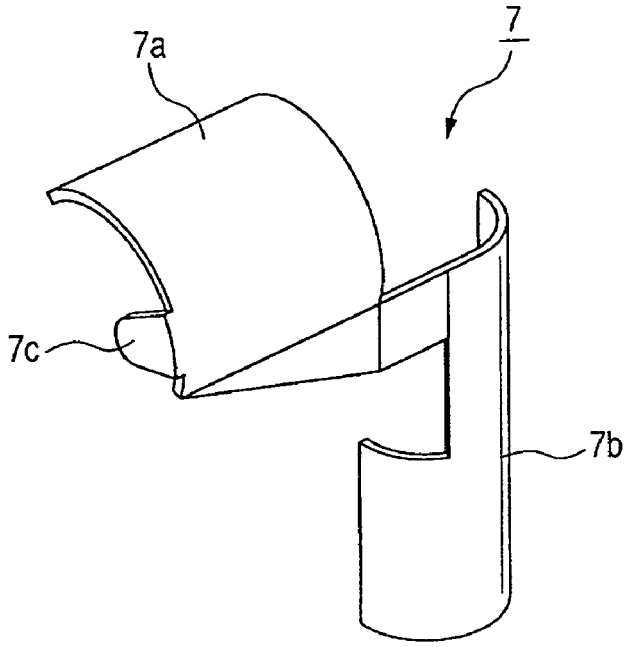
FIG. 5 is a view showing a detachment preventing member to be employed in the voltage supply unit of the present invention.
Figure 6:
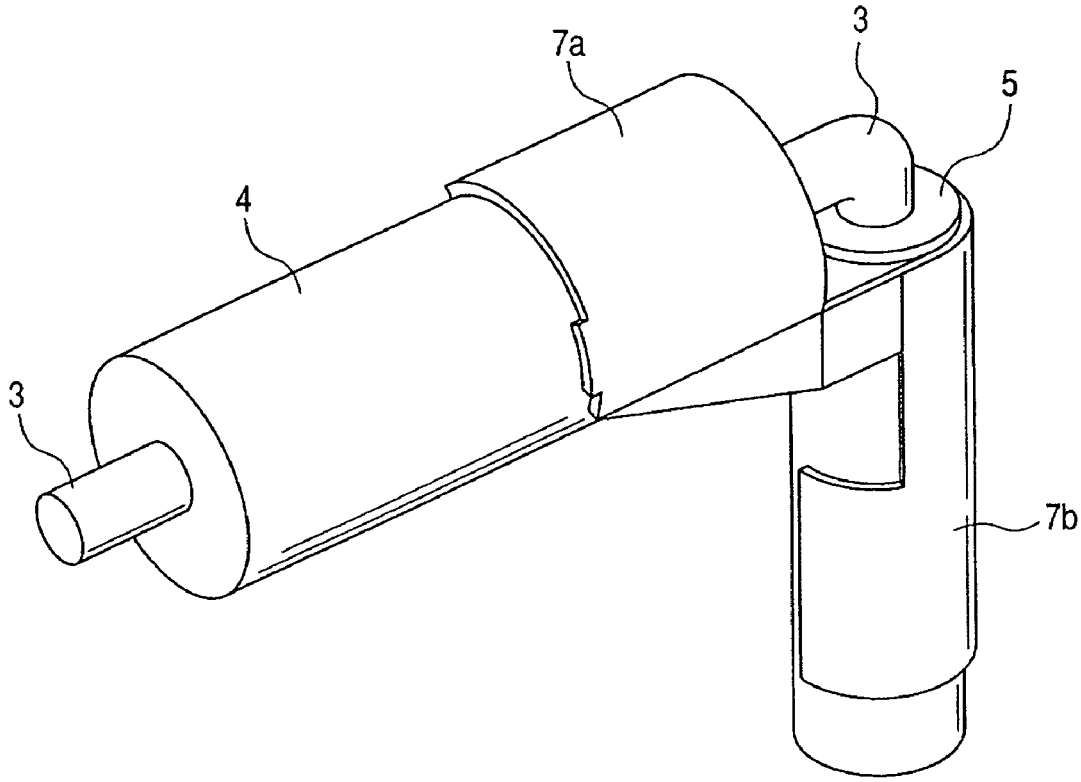
FIG. 6 is a view showing a state in which a cable and a connecting member are attached to the detachment preventing member shown in FIG. 5.

Also the connection member 5 is supported by the top portion 1*b* of the anode cap 1, but a detachment preventing member 7, formed for example with a stainless steel plate, is preferably employed in order to prevent a detachment from the top portion 1*b*. As shown in FIG. 2, the detachment preventing member 7 has a cable holding unit 7*a* and a connection member holding unit 7*b*. FIG. 5 shows an entire member, and FIG. 6 shows a state in which the cable 4 and the connection member 5 are mounted on the detachment preventing member. The detachment preventing member 7 is provided, at an end of the cable holding unit 7*a*, with a claw 7*c* which is pointed toward the cable 4. The claw 7*c* is made to stab into the cable 4, thereby mechanically fixing the cable holding unit 7*a* to the cable 4, while the connection member holding unit 7*b* is fixed on the connection member 5 by caulking. Such detachment preventing member 7 relaxes a stress applied to a soldered portion between the electroconductive wire 3 and the connection member 5.

In the voltage supply unit 3 of the present invention, a voltage source 6 is connected to the other end of the electroconductive wire 3 as shown in FIG. 2. The electroconductive wire 3 and the voltage source 6 may be connected through a connector if necessary, thereby rendering the electroconductive wire 3 detachable from the voltage source. The voltage source 6 is capable of generating a high DC voltage, for example by a fly-back transformer employed for a cathode ray tube in a prior television receiver.

In the present invention, such voltage supply unit is detachably mounted on the anode terminal 16 of the display panel. Therefore, in case of any failure in the unit 2, such unit 2 may be entirely replaced to dispense a cumbersome operation for identifying the failed part.

As a peripheral structure of the anode terminal of the display panel, for mounting the voltage supply unit of the present invention, a fixing member 12 is fixed around the anode terminal 16 which is fixed on the external surface of the panel. In the structure shown in FIG. 3, a substrate 11 constituting the external surface of the display panel is provided with an aperture 11*a* for an electrical conduction between the anode terminal 16 and an internal lead wiring 24, and the aperture 11*a* is closed by a sealing member 13 from the external side. The sealing member 13 is adhered by an adhesive material 14 to the substrate 11, and has a central through hole in which the anode terminal 16 is inserted and fixed. Also a fixing member 12, having a through hole 12*b* at the center, is adhered by an adhesive material 15 to the substrate 11, so as to surround the periphery of the anode terminal 16.

In the present invention, the anode terminal 16 is formed by an electroconductive material, for example Ag, Cu or a Ni—Co alloy. Also the sealing member 13 is formed by a disk-shaped member of ceramics such as alumina or of glass, and a through hole for holding the anode terminal 16 is formed at the center. The anode terminal 16 inserted into the through hole and the sealing member 13 are hermetically sealed by soldering with a solder material such as Ag—Cu or Au—Ni.

The aperture 11*a* of the substrate 11 is formed circularly, for example by a mechanical working with an ultrasonic working machine. The sealing member 13 is not limited to a circular shape as long as it can seal the aperture 1l*a*, and also the aperture is not limited to a circular shape.

By inserting the connection member 5 of the voltage supply unit 2 shown in FIG. 2 into the through hole 12*b* of the fixing member 12 as shown in FIG. 3, the anode terminal 16 is inserted into a fitting portion 5*a* of the connection member 5. Also the anode terminal 16 is electrically connected to the electroconductive wire 3 through the connection member 5.

Also the anode cap 1 is fixed to the fixing member 12 by fitting the fixing member 12 into the anode cap 1 whereby the convex portion 1*d* fastened to the concave portion 12*a*. In this manner, the voltage supply unit 2 is firmly fixed with the display panel.

The fixing member 12 to be employed in the present invention is preferably formed by an elastic member, like the anode cap 1, for enabling easy attachment/detachment of the anode cap 1. For example, an elastic material such as PBT (polybutylene terephthalate) resin is preferably employed. The fixing member 12 is preferably formed by an annular member, but the present invention is not limited to such form, and the fixing member may also be constituted of plural members, discontinuously provided around the anode terminal 16. Also an anode cap of any shape, that is not detached by a certain impact and allows each detachment, may be suitably employed. The present embodiment shows a constitution in which the fixing member 12 is fitted inside anode cap 1, but the present invention is not limited to such constitution as long as the anode cap 1 and the fixing member 12 can be mutually engage in detachable manner.

The sealing member 13 and the substrate 11 are adhered by the adhesive material 14, which is formed by low-temperature glass such as frit glass. Also the fixing member 12 and the substrate 11 are adhered by the adhesive material 15, which is formed for example by an epoxy adhesive or curable silicone rubber.

When the voltage supply unit 2 of the present invention is mounted on the display panel, a contact between the anode cap 1 and the substrate 11 is ensured by a pressing force of the anode cap 1, by the convex portion 1*d* shown in FIG. 4, toward the substrate 11, and a repulsive force of a curved end portion of the cover portion 1*c* of the anode cap 1 against the pressing force. The contact can be improved preferably by providing insulating grease between the cover portion 1*c* and the substrate 11.

The voltage supply unit 2 shown in FIG. 2 can be attached to the display panel shown in FIG. 3 in the following manner.

At first an end portion of the cup-shaped cover portion 1*c* of the anode cap 1 is folded up to such a height that a lateral face of the connection member 5 becomes visible by about a half or more. Then the connection member 5 is inserted and fitted in the through holes 12*a* of the fixing member 12, while inserting the anode terminal 16, positioned at the center of the fixing member 12, into the fitting portion 5*a* of the connection member 5. Thereafter, by returning the folded-up cover portion 1*c* to the original state, the internal convex portion 1*d* is made to enter and fastened to the concave portion 12*a* of the fixing member 12.

Also the voltage supply unit 2, mounted on the display panel as shown in FIG. 4, can be detached therefrom in the following manner.

At first an end portion of the cup-shaped cover portion 1*c* of the anode cap 1 is folded up and the internal convex portion 1*d* is extracted out from the concave portion 12. Then the end portion of the cover portion 1*c* is folded up to such a position that the connection member 5, protruding from the through hole 12*a* of the fixing member 12, becomes visible, and the connection member 5 is extracted from the through hole 12, thereby detaching the voltage supply unit 2 from the display panel.

FIG. 4 shows a constitution in case an image display apparatus of the present invention is applied to a flat display panel of a form in which an anode potential is supplied to a substrate 21 opposed to a substrate 11 on which a voltage supply unit 2 is mounted.

Figure 7:
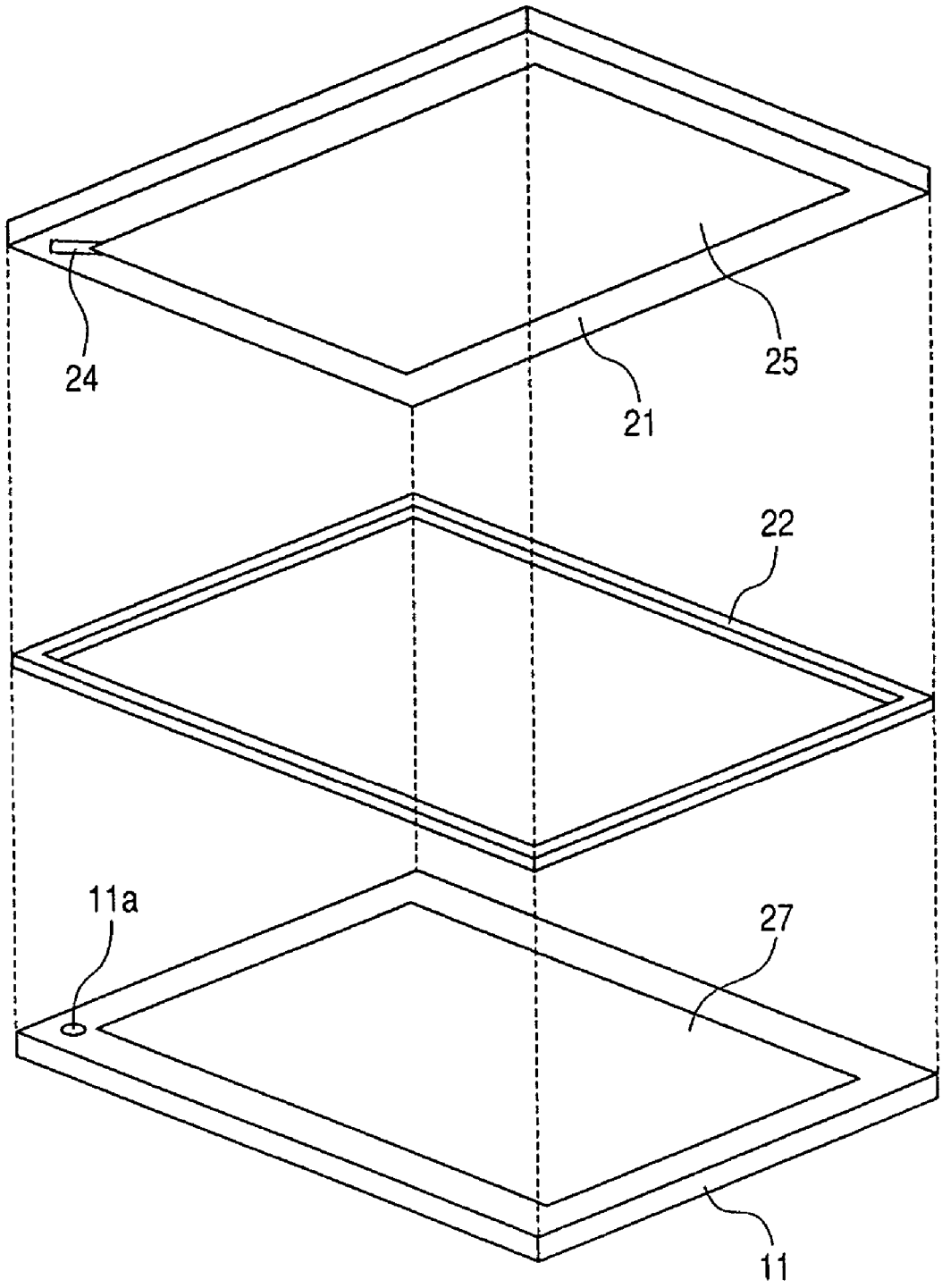
FIG. 7 is a schematic exploded view of a vacuum envelope of the image display apparatus of the present invention.

In the embodiment shown in FIG. 4, a substrate (rear plate) 11 provided with an electron source 27 and a substrate (face plate) 21 provided with a phosphor film 26 and a metal back (anode electrode) 25 are positioned in a mutually opposed manner. Also an outer frame 22 is positioned between the substrates 11, 21 to constitute, together with such substrates 11, 21, an air-tight envelope. FIG. 7 is an exploded perspective view of the air-tight envelope, of which an interior is maintained at a reduced pressure, preferably $10^{-4}$-$10^{-6}$ Pa. The outer frame 22 is constituted of a frame-shaped member, and a sealant such as glass or a metal for adhering the frame-shaped member to the substrates 11, 21. For the substrates 11, 21 and the frame-shaped member, there may be employed soda lime glass, soda lime glass bearing an SiO2 film on a surface, glass with a lowered Na content, or quartz glass.

Figure 8:
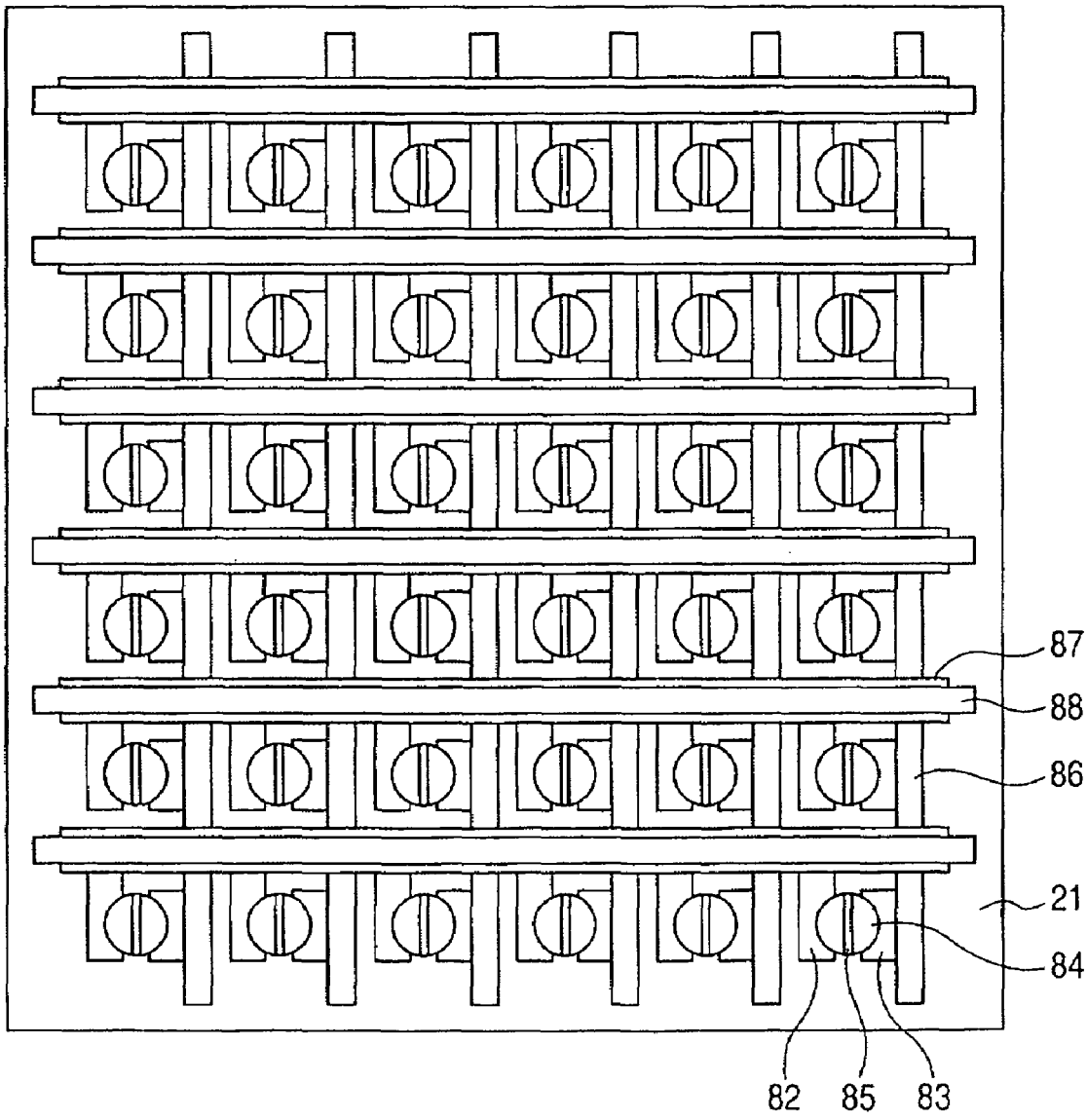
FIG. 8 is a schematic plan view showing a structure of an electron source to be employed in the image display apparatus of the present invention.

FIG. 8 is a schematic plan view of showing a structure of the electron source 27, wherein shown are device electrodes 82, 83, a conductive film 84, an electron emitting portion 85 formed on the conductive film 84, a column wiring 86, an interlayer insulation film 87, and a row wiring 88. Surface conduction-type electron emitting elements, each constituted of the device electrodes 82, 83, and the conductive film 84 including the electron emitting portion 85, are wired in a matrix by the plural column wirings 86 and row wirings 88, provided across the interlayer insulation film 87. In the electron source 27 of the present invention, a field emission (FE) element, a surface conduction electron-emitting element, or an MIM element is employed advantageously.

Figure 9:
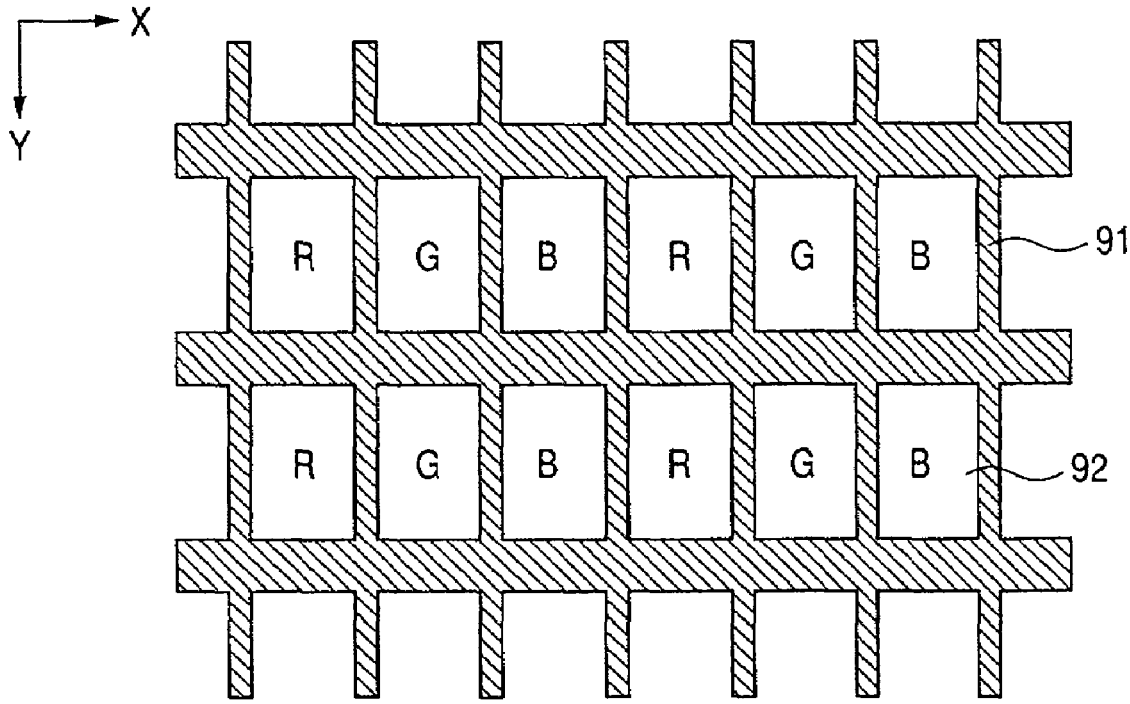
FIG. 9 is a schematic plan view showing a structure of a phosphor film to be employed in the image display apparatus of the present invention.

FIG. 9 is a plan view showing a structure of the phosphor film 26, including a phosphor 91 and a black electroconductive member 92. As shown in FIG. 9, the photphor film 26 is constituted of phosphors 91 of R (red), G (green) and B (blue), and a black electroconductive member 92 for light shielding between the adjacent phosphors 91. FIG. 9 shows an example in which plural linear black conductive members 92 are arranged in X- and Y-directions to constitute a black matrix, but there may also be employed black stripes formed by plural linear black electroconductive members arranged in one direction in parallel manner.

On an internal surface of the phosphor film 26, there is formed a metal back 25 serving also as an anode electrode for accelerating electrons emitted from the electron source 27, and also serving to reflect a light, emitted from the phosphor film 26 toward the substrate 11, back toward the substrate 21.

The column wiring 86 and the row wiring 88 in FIG. 8 are connected to unillustrated lead wirings, which are embedded in the insulating sealant between the substrate 11 and the outer frame 22 and extracted to the exterior of the air-tight container, for connection with an external power source for driving the electron source 27.

Also the metal back 25 shown in FIG. 4 is connected to a lead wiring 24, extracted to a corner of the substrate 21. Also the lead wiring 24 and the anode terminal 16 mounted on the substrate 11 are electrically connected by an electroconductive elastic member 23. The metal back receives an anode potential from the voltage source 6, through the voltage supply unit 2 connected to the anode terminal 16.

The lead wiring 24 is formed by an electroconductive material such as Ag, and is formed for example by a printing method. The elastic member 26 is a spring member formed by an electroconductive material such as stainless steel, and can be pressed to the lead wiring 24 thereby further securing the electrical contact between the anode terminal 16 and the lead wiring 24. The elastic member 16 and the anode terminal 16 are connected for example by a laser welding, an electroconductive adhesive or a metal adjoining. In the present invention, the anode terminal 16 may be directly connected to the lead wiring 24 without employing the elastic member 26.

In the above-described structure, the electron source 27 is given a low potential for example of 10-100 V. On the other hand, the metal back 25 receives a high potential for example of 500 V to 30 kV. Thus electrons emitted from the electron source 27 are accelerated and irradiates the phosphor 92, thereby executing an image display.

This application claims priority from Japanese Patent Application No. 2005-110707 filed on Apr. 7, 2005, which is hereby incorporated by reference herein.

What is claimed is:

1. An image display apparatus comprising:

a display panel including an anode electrode and an anode terminal, wherein the anode is disposed at an interior portion of the display panel, and the anode terminal applies a voltage to the anode from outside of the display panel,the anode terminal including a first portion disposed in the interior portion of the display panel and a second portion disposed outside of the display panel;

an anode cap, attached on an external surface of the display panel, for holding an electroconductive wire applying a voltage to the anode terminal;

a fixing member for detachably fastening the anode cap, the fixing member having a through hole in which the second portion of the anode terminal is inserted, and the fixing member being fixed to the external surface of the display panel; and a connection member supported in an interior portion of the anode cap, wherein the connection member includes a first end for receiving the electroconductive wire and a second end for receiving the anode terminal.

2. An image display apparatus according to claim 1, wherein the fixing member includes a concave or convex portion, and the anode cap includes a fastening portion having a concave or convex portion.

3. An image display apparatus according to claim 1, wherein the display panel comprises a rear plate with an electron source, and a face plate with the anode electrode to which a voltage is applied through the anode terminal.

4. An image display apparatus according to claim 3, wherein an aperture is formed through the rear plate for receiving the anode terminal.

5. An image display apparatus comprising:

a display panel including an anode and an anode terminal, wherein the anode is disposed at an interior portion of the display panel, and the anode terminal applies a voltage to the anode from outside of the display panel, the anode terminal including a first portion disposed in the interior portion of the display panel and a second portion disposed outside of the display panel, the display panel further including electron emitting elements;

an anode cap, attached on an external surface of the display panel, for holding an electroconductive wire applying a voltage to the anode terminal;

a fixing member for detachably fastening the anode cap, the fixing member having a through hole in which the second portion of the anode terminal is inserted, and the fixing member being fixed to the external surface of the display panel; and a connection member supported in an interior portion of the anode cap, wherein the connection member includes a first end for receiving the electroconductive wire and a second end for receiving the anode terminal.

6. An image display apparatus according to claim 5, wherein the display panel comprises a rear plate with the electron emitting elements, and a face plate with the anode electrode to which a voltage is applied through the anode terminal.

7. An image display apparatus according to claim 6, wherein an aperture is formed through the rear plate for receiving the anode terminal.

* * * * *